United States Patent [19]

Schranz et al.

[11] 4,339,515

[45] Jul. 13, 1982

[54] METHOD OF STABILIZING COLOR PHOTOGRAPHIC MATERIALS AND A COLOR PHOTOGRAPHIC MATERIAL

[75] Inventors: Karl-Wilhelm Schranz, Odenthal; Johannes Sobel, Leverkusen, both of Fed. Rep. of Germany

[73] Assignee: AGFA-Gevaert Aktiengesellschaft, Leverkusen, Fed. Rep. of Germany

[21] Appl. No.: 184,034

[22] Filed: Sep. 4, 1980

[30] Foreign Application Priority Data

Sep. 8, 1979 [DE] Fed. Rep. of Germany ..... 2936410

[51] Int. Cl.[3] ..... G03C 7/00

[52] U.S. Cl. ..... 430/17; 430/372; 430/463; 430/551

[58] Field of Search ..... 430/372, 551, 546, 543, 430/17, 463

[56] References Cited

U.S. PATENT DOCUMENTS

| | | | |
|---|---|---|---|
| 2,579,435 | 12/1951 | Mackey | 430/372 |
| 2,579,436 | 12/1951 | Mackey | 430/372 |
| 3,471,295 | 10/1969 | Bockly et al. | 430/551 |
| 3,689,271 | 9/1972 | Nittel et al. | 430/543 |
| 3,887,376 | 6/1975 | Wilson et al. | 96/66 R |
| 3,893,863 | 7/1975 | Wilson et al. | 96/95 |
| 4,087,283 | 5/1978 | Battisti | 430/543 |
| 4,146,399 | 5/1979 | Trunley et al. | 430/546 |

*Primary Examiner*—J. Travis Brown

*Attorney, Agent, or Firm*—Connolly and Hutz

[57] ABSTRACT

Compounds containing the group $$-CO-\underset{|}{N}-OH$$

are useful in photographic materials for preventing fading of dye images.

3 Claims, No Drawings

METHOD OF STABILIZING COLOR PHOTOGRAPHIC MATERIALS AND A COLOR PHOTOGRAPHIC MATERIAL

This invention relates to a method of stabilizing colour photographic materials and to the stabilized colour photographic materials in which compounds containing the group

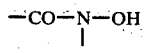

are used to prevent fading of the dye images.

Phenolic couplers, i.e. phenols and naphthols, are normally used for producing cyan dye images, pyrazolone, indazolone or cyanoacetyl couplers are normally used for producing magenta dye images and open chain ketomethylene compounds, e.g. acylacetamide or dibenzoylmethane couplers for producing yellow dye images.

In the known colour photographic processes, the couplers which form dyes are either introduced into a developer solution or incorporated in the light-sensitive photographic emulsion layers or other dye forming layers so that they can react with the oxidation products of the colour developer compounds during development to form the dye.

It is well known that the dye images produced in the manner described above do not have unlimited stability under the action of UV radiation or visible light and therefore gradually fade under prolonged exposure to light.

Attempts have been made to overcome this disadvantage, for example by incorporating UV absorbents in the colour photographic material in order to reduce the damaging effect of the UV radiation. However, the use of a UV absorbent in no way prevents the fading of the dye image which is due to the action of visible light, so that the improvement in the stability of the dye to the action of light achieved by using UV absorbents is limited and not completely satisfactory.

It is also known to increase the stability to light of the visible spectrum. Information on this subject may be found, for example, in British Pat. Nos. 909,824; 909,825 and 909,826 and U.S. Pat. Nos. 3,095,302; 3,801,322 and 3,775,124.

A particular disadvantage of the known methods of improving the stability to light, is that the antifading effect diminishes if the colour photographic material is stored for a long time and may even be destroyed completely after a certain time. In addition, so-called "after-yellowing" is found to occur in some cases due to the action of actinic radiation on areas of processed colour photographic material which contain unreacted couplers, i.e. the unexposed areas. Some of these compounds are only very sparingly soluble in the solvent when added to a colour photographic material. Due to their diffusibility, some of the compounds diffuse into processing solutions at a high pH. Although some of these compounds demonstrate an antifading effect in colour images formed by yellow and cyan couplers, they do not have such an effect in the colour images produced from magenta couplers. Other compounds again, have no effect on the colour images produced from yellow and cyan couplers and, in some cases, even accelerate fading although they have a relatively efficient anti-fading action on colour images produced from magenta couplers.

It is an object of the present invention to stabilise a colour photographic material, in particular against fading due to visible light, without producing any deleterious effects on the material.

There have now been found (1) A process for stabilizing a photographic material containing a support layer, at least one hydrophilic binder layer and at least one dye image, by the development of an exposed light-sensitive colour photographic material followed by treatment in an after-treatment bath containing at least one water-soluble compound carrying the group

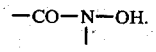

This after-treatment bath is preferably used as the final processing bath, after fixing.

In a preferred embodiment, the compounds to be used according to the invention corresponding to one of the formulae I, II or III below:

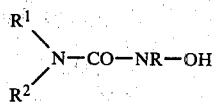

I

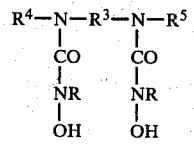

II

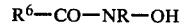

III in which

R represents hydrogen or an alkyl group, in particular with not more than 3 carbon atoms, specifically methyl or ethyl;

$R^1$ represents hydrogen or an alkyl group, in particular with not more than 5 carbon atoms, specifically methyl, ethyl, propyl, butyl or pentyl;

$R^2$ represents an alkyl group, in particular with not more than 4 carbon atoms, specifically methyl, ethyl, propyl or butyl; a cycloalkyl group, in particular with 5 or 6 carbon atoms, specifically cyclopentyl or cyclohexyl; an aralkyl group, in particular with not more than 2 carbon atoms in the aliphatic moiety and 6 carbon atoms in the aromatic moiety, specifically benzyl; or an aryl group specifically phenyl;

$R^3$ represents a divalent hydrocarbon group, in particular an alkylene group, preferably with not more than 6 carbon atoms, or an arylene group, in particular phenylene;

$R^4$ and $R^5$ which may be the same or different represent hydrogen or an alkyl group, in particular with not more than 3 carbon atoms, specifically methyl, ethyl or propyl;

$R^6$ represents an alkyl group, in particular with not more than 6 carbon atoms and especially with 1 to 5 carbon atoms; a cycloalkyl group, in particular with 5 or 6 carbon atoms, specifically cyclopentyl or cyclohexyl; an aralkyl group, in particular with not more than 2 carbon atoms in the aliphatic moiety and 6 carbon atoms in the aromatic moiety; or aryl, in particular phenyl, and/or $R^1$ and $R^2$ may together represent the atoms required to complete a heterocylic ring and/or $R^3$ together with $R^4$ and optionally also $R^5$ represent the atoms required to complete a heterocyclic ring; and (2) A colour photographic material comprising a support and at least one hydrophilic layer of binder containing a dye image, the material containing at least one of the compounds to be used according to the invention, in particular one of the compound I to III.

Such materials can be prepared by the process according the invention. The groups R and $R^1$ to $R^6$ may be substituted with the usual substituents for photographic materials. Examples of such substituents include halogens such as chlorine, sulpho, methyl, ethyl, methoxy and ethoxy.

In a preferred embodiment, the substituents R to $R^6$ have the following meaning:

R represents hydrogen, methyl or ethyl;

$R^1$ represents hydrogen, methyl, ethyl, propyl, butyl or pentyl;

$R^2$ represents methyl, ethyl, propyl, butyl, cyclohexyl, phenyl, benzyl or cyclohexyl;

$R^3$ represents hexylene or phenylene;

$R^4$ represents hydrogen, methyl, ethyl or propyl;

$R^5$ represents hydrogen, methyl ethyl or propyl; and $R^6$ represents methyl, ethyl, propyl, butyl, pentyl or phenyl.

The compounds shown in Tables 1, 2 and 3 have proved to be particularly suitable.

TABLE 1

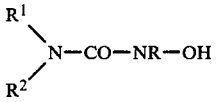

(I)

| | R | $R^1$ | $R^2$ | 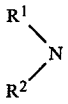 |
|---|---|---|---|---|
| 1.1 | H | H | i-$C_3H_7$ | — |
| 1.2 | H | H | Cl—$CH_2$—$CH_2$—$CH_2$ | — |
| 1.3 | H | H | n-$C_4H_9$ | — |
| 1.4 | H | H | n-$C_6H_{13}$ | — |
| 1.5 | H | H | Cyclohexyl | — |
| 1.6 | H | $C_2H_5$ | $C_2H_5$ | — |
| 1.7 | H | n-$C_4H_9$ | n-$C_4H_9$ | — |
| 1.8 | H | i-$C_4H_9$ | i-$C_4H_9$ | — |
| 1.9 | H | $CH_3$ | Cyclohexyl | — |
| 1.10 | H | $C_2H_5$ | Cyclohexyl | — |
| 1.11 | H | H | Phenyl | — |
| 1.12 | H | H | 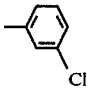 | — |
| 1.13 | H | H | 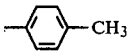 | — |
| 1.14 | H | H | 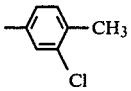 | |
| 1.15 | H | H | 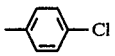 | |
| 1.16 | $CH_3$ | H | | |
| 1.17 | $C_2H_5$ | H | Phenyl | — |
| 1.18 | H | $CH_3$ | Benzyl | — |
| 1.19 | H | $CH_3$ | Phenyl | — |

TABLE 1-continued

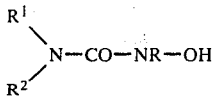

(I)

| | R | $R^1$ | $R^2$ | 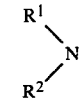 |
|---|---|---|---|---|
| 1.20 | H | $C_2H_5$ | Phenyl | — |
| 1.21 | H | $C_2H_5$ | 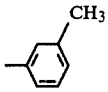 | — |
| 1.22 | H | $C_2H_5$ | 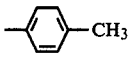 | — |
| 1.23 | H | — | — | 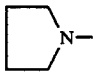 |
| 1.24 | H | — | — | 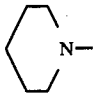 |
| 1.25 | H | — | — | 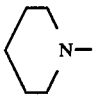 |
| 1.26 | H | — | — | 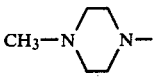 |
| 1.27 | H | — | — | 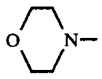 |
| 1.28 | H | — | — | 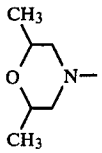 |
| 1.29 | H | H | 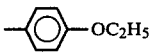 | — |

TABLE 2

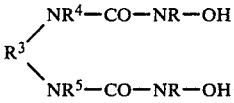

| | R | $R^3$ | $R^4$ | $R^5$ | —$R^5$N—$R^3$—$NR^4$— |
|---|---|---|---|---|---|
| 2.1 | H | $(CH_2)_6$ | H | H | — |
| 2.2 | H | $(CH_2)_6$ | i-$C_3H_7$ | i-$C_3H_7$ | — |
| 2.3 | H | 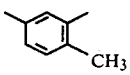 | H | H | — |

TABLE 2-continued

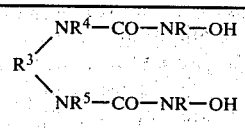

| | R | $R^3$ | $R^4$ | $R^5$ | $—R^5N—R^3—NR^4—$ |
|---|---|---|---|---|---|
| 2.4 | H | — | — | — | 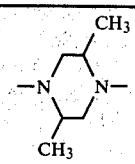 |

TABLE 3

| | $R^6$—CO—NR—OH | |
|---|---|---|
| | R | $R^6$ |
| 3.1 | H | $CH_3$ |
| 3.2 | H | $C_2H_5$ |
| 3.3 | H | $C_3H_7$ |
| 3.4 | H | $C_4H_9$ |
| 3.5 | H | $(CH_3)_2$—CH—$CH_2$ |
| 3.6 | H | Phenyl |

The compounds to be used according to the invention may be prepared by methods known in the literature. Suitable methods of preparing compounds of formulae I and II may be found, for example, in German Auslegeschriften Nos. 1,127,344; 1,129,151; 1,131,655 and 1,135,890 and German Offenlegungsschrift No. 2,415,603, while compounds of formula III may be prepared, for example, by methods given in Houben-Weyl, Methoden der Organischen Chemie, Volume 8, pages 684 et seq or in "Organic Functional Group Preparations", Academic Press, New York, Chapter 12, pages 406 et seq.

Although the use of certain hydroxyureas has already been disclosed in U.S. Pat. Nos. 3,893,863 and 3,887,376, in these patents they are used as developer substances (a) in developer baths and (b) in photographic materials, particularly also in heat sensitive materials.

The compounds to be used according to the invention, in particular the compounds of formulae I to III, are effective stabilizers for improving the stability to light of indophenol, indoaniline and azomethine dyes which have been produced by chromogenic development. They may be used in color diffusion systems.

The compounds to be used according to the invention for preventing fading may be used in combination with a UV absorbent, whereby the lightfastness of the colour image can be improved even further. Examples of suitable UV absorbents include benzophenone, acrylonitrile, thiazolidone, benzotriazole, stilbene, oxazole, thiazole and imidazole compounds.

The compounds to be used according to the invention are mainly colourless and therefore do not impair the image whites and have no deleterious effect on colour development or on the other photographic additives.

If desired, two or more of the compounds to be used according to the invention may be used in a material. The compounds may also be used together with other known stabilizers, anti-blotching agents, for example hydroquinones containing ballast groups, and phenolic anti-oxidants.

The concentration of the compounds to be used according to the invention in the photographic baths may vary considerably and depends mainly on the amount of improvement in stability required. The compounds are suitably used in baths in quantities of 10 to 100 g per liter of treatment solution, preferably 10 to 50 g per liter. The treatment substance should not be at too high a concentration in order that it may not form a visible deposit on the surface of the photographic material after drying. The time required for immersion of the photographic material in the stabilizing bath depends on the speed with which the treatment substance can penetrate the photographic layer, but a treatment time in the range of 15 seconds to 5 minutes is generally sufficient.

In the completely developed photographic image, the compounds to be used according to the invention are preferably at a concentration above 100 mg/m$^2$. Concentrations of 150 to 2000 mg/m$^2$ are preferred, in particular from 150 to 800 mg/m$^2$.

The present invention is suitable for photographic materials containing any silver halide emulsions in which the silver halide may consist of silver bromide, silver chloride or mixtures thereof, which may have a small silver iodide content of up to 10 mol %.

The photographic materials may be developed with the usual colour developer substances, e.g. N,N-dimethyl-p-phenylenediamine, 4-amino-3-methyl-N-ethyl-N-methoxyethylaniline, 2-amino-5-diethylaminotoluene, N-butyl-N-$\omega$-sulphobutyl-p-phenylenediamine, 2-amino-5-(N-ethyl-N-$\beta$-methanesulphonamidoethylamino)-toluene, N-ethyl-N-$\beta$-hydroxyethyl-p-phenylenediamine, N,N-bis-($\beta$-hydroxyethyl)-p-phenylenediamine and 2-amino-5-(N-ethyl-N-$\beta$-hydroxyethylamino)-toluene. Other suitable colour developers have been described, for example, in J. Amer. Chem. Soc. 73, 3100 (1951).

The photographic material may contain the usual colour couplers which may be incorporated directly in the silver halide layers. Examples of suitable colour couplers may be found in the publication entitled "Farbkuppler" by W. Pelz in "Mitteilungen aus den Forschungslaboratorien der Agfa, Leverkusen/Munchen", Volume III (1961) and the publication by K. Venkataraman in "The Chemistry of Synthetic Dyes", Vol. 4, 341 to 387, Academic Press, 1971.

2-Equivalent couplers may also be used as non-diffusible colour couplers, for example, the known DIR couplers. The non-diffusible colour couplers and colour producing compounds may be added to the light-sensitive silver halide emulsions or to other casting solutions by the usual methods.

If the non-diffusible colour couplers and colour producing compounds used are insoluble in water and alkalies, they may be emulsified in known manner. So-called coupler solvents or oil formers may also be added for emulsifying such hydrophobic compounds; information on this may be found, for example, in U.S. Pat. Nos. 2,322,027; 2,533,514; 3,689,271; 3,764,336 and 3,765,897.

The binder used for the photographic layers is preferably gelatine, but this may be partly or completely replaced by other natural or synthetic binders.

The emulsions may also be chemically sensitized, e.g. by the addition of sulphur compounds such as allyl isothiocyanate, allyl thiourea or sodium thiosulphate at the chemical ripening stage. Reducing agents may also be used as chemical sensitizers, e.g. the tin compounds described in Belgian Pat. No. 493,464 or Belgian Pat. No. 568,687, or polyamines such as diethylenetriamine or aminomethylsulphinic acid derivatives, e.g. according to Belgian Pat. No. 547,323. Noble metals such as gold, platinum, palladium, iridium, ruthenium or rhodium and compounds of these metals are also suitable chemical sensitizers. The emulsions may also be sensitized with polyalkylene oxide derivatives, e.g. with a polyethylene oxide having a molecular weight in the range of 1000 to 20,000, or with condensation products of alkylene oxides and alcohols, aliphatic carboxylic acids, aliphatic amines, aliphatic diamines and amides.

The emulsions may also be optically sensitized, e.g. with the usual polymethine dyes such as neutrocyanines, basic or acid carbocyanines, rhodacyanines, hemicyanines, styryl dyes, oxonoles and the like. Sensitizers of this type have been described in the work by F. M. Hamer "The Cyanine Dyes and related Compounds" (1964).

The emulsions may contain the usual stabilizers, e.g. homopolar or salt-type compounds of mercury containing aromatic or heterocyclic rings, such as mercaptotriazoles, simple mercury salts, sulphonium mercury double salts and other mercury compounds. Azaindene are also suitable stabilizers, particularly tetra- or penta-azaindenes and especially those which are substituted with hydroxyl or amino groups. Compounds of this type have been described, e.g. in the article by Birr, Z. Wiss.Phot. 47 (1952), 2 to 58. Other suitable stabilizers include inter alia heterocyclic mercapto compounds, e.g. phenylmercaptotetrazole, quaternary benzothiazole derivatives and benzotriazole.

The layers of the photographic material may be hardened in the usual manner, for example with formaldehyde or halogen-substituted aldehydes containing a carboxyl group, such as mucobromic acid, diketones, methanesulphonic acid esters and dialdehydes. The photographic layers may also be hardened with epoxide, heterocyclic ethyleneimine or acryloyl hardeners. The layers may also be hardened by the process according to German Offenlegungsschrift No. 2,218,009 to produce colour photographic materials suitable for high temperature processing. The photographic layers or colour photographic multilayered materials may also be hardened with diazine, triazine or 1,2-dehydroquinoline hardeners. Examples of such hardeners include diazine derivatives containing alkylsulphonly or acrylsulphonyl groups, derivatives of hydrogenated diazines or triazines, e.g. 1,3,5-hexahydrotriazine, fluorosubstituted diazine derivatives, e.g. fluoropyrimidine, and esters of 2-substituted 1,2-dihydroquinoline- or 1,2-dihydroisoquinoline-N-carboxylic acids. Other suitable hardeners include the vinylsulphonic acid hardeners and the carbodiimide and carbamoyl hardeners described, for example, in German Offenlegungsschriften Nos. 2,263,602; 2,225,230 and 1,808,685, French Pat. No. 1,491,807, German Pat. No. 872,153 and DDR Pat. No. 7,218. Other suitable hardeners have been described, for example, in British Pat. No. 1,268,550.

EXAMPLE 1

I. Preparation of the emulsion

1. Magenta emulsions 5 g of sulphosuccinic acid-bis-(2-ethylhexyl)-ester followed by 50 g of magenta coupler corresponding to the following formula

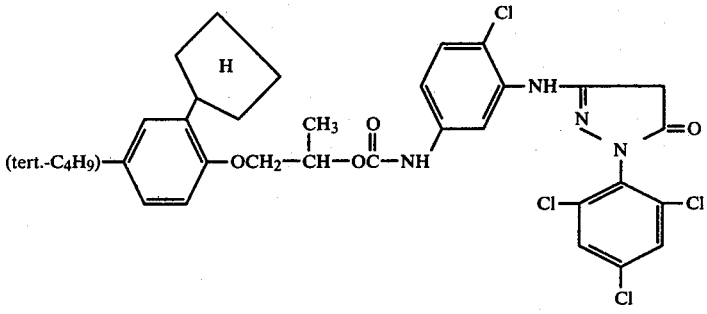

are dissolved in 100 g of diethylcarbonate at 40° C.

50 g of a 50% solution (in diethylcarbonate) of the compound corresponding to the following formula

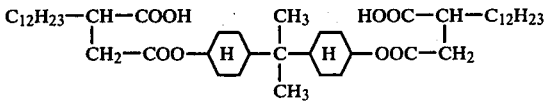

and 40 g of a 30% methanolic solution of the compound corresponding to the formula

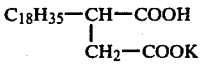

are added as oil formers.

This mixture is emulsified in 1000 ml of a 10% gelatine solution by stirring with a high speed stirrer at 50° C. The solvent is removed in a thin layer evaporator and the emulsion is stored at 4° C.

2. Yellow emulsions 5 g of sulphosuccinic acid-bis-(2-ethylhexyl)-ester followed by 50 g of yellow coupler corresponding to the following formula

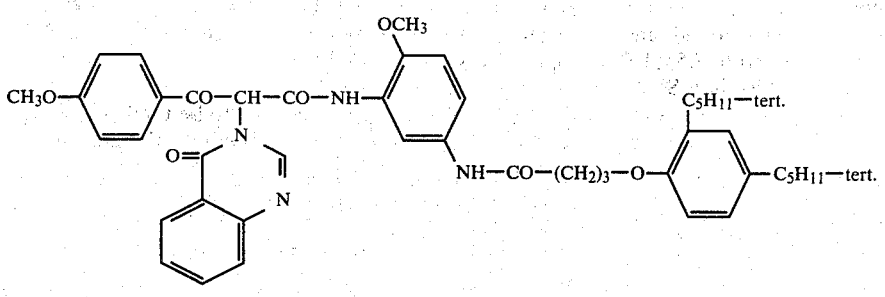

are dissolved in 200 g of diethylcarbonate at 40° C.

25 g of a 50% solution (in diethylcarbonate) of the compound corresponding to the formula

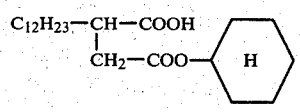

and 15 g of dibutylphthalate are added as oil formers. This mixture is emulsified in 1000 ml of a 10% gelatine at 50° C. The solvent is removed in a thin layer evaporator and the emulsion is stored at 4° C.

3. Cyan emulsions 5 g of sulphosulphinic acid-bis-(2-ethylhexyl) ester followed by 35 g of cyan coupler corresponding to the following formula

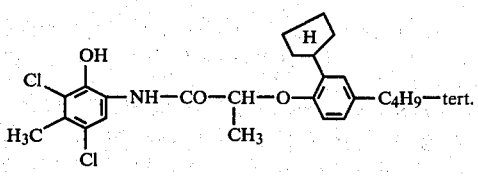

are dissolved in 175 g of diethylcarbonate at 40° C.

35 g of a 50% solution (in diethylcarbonate) of the compound corresponding to the formula

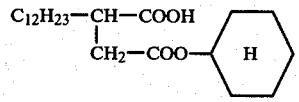

and 30 g of a 30% methanolic solution of the compound corresponding to the formula

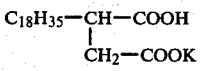

are added as oil formers.

This mixture is emulsified in 1000 ml of a 10% gelatine at 50° C. The solvent is removed in a thin layer evaporator and the emulsion is stored at 4° C.

II. Preparation of a colour photographic material for viewing by reflected light A reflection viewing colour photographic material is prepared by applying one after another the layers listed below to a paper substrate which has been laminated with polyethylene and coated with a bonding layer. The emulsion layers described below contain the usual additions of wetting agents, stabilizers, etc.

1. As lowermost layer, a 4μ thick blue-sensitive silver bromide emulsion layer containing, per kg of emulsion, 25.4 g of silver (88% AgBr, 12% AgCl), 80 g of gelatine and 860 g of the yellow emulsion described under I.2;

2. a 1μ thick gelatine layer as intermediate layer;

3. as middle layer, a 4μ thick green-sensitive silver chlorobromide emulsion layer containing, per kg. of emulsion, 22 g of silver (77% AgCl, 23% AgBr), 80 g of gelatine and 650 g of the magenta emulsion described under I.1;

4. A 4μ thick UV protective layer containing, per $m^2$, 0.7 g of UV absorbent corresponding to the following formula

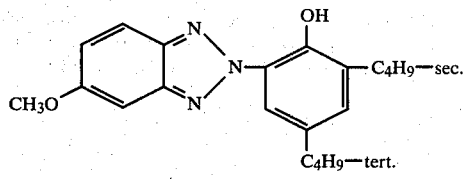

5. as top layer, a 4μ thick red sensitive silver chlorobromide emulsion layer containing, per kg of emulsion, 23 g of silver (80% AgCl, 20% AgBr), 80 g gelatine and 640 g of the cyan emulsion described under I.3;

6. a 1μ thick layer of gelatin.

III. Comparison of the stability of the dye

The material produced as described above was exposed behind a colour separation wedge and processed in the following baths:

Colour developer
Bleaching bath
Fixing bath
Washing bath
Aftertreatment bath.

The colour developer compound used had the following composition:

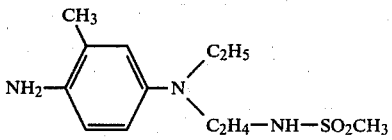

The aftertreatment bath contained the compounds used according to the invention which are shown in Table 4. This Table also shows the reduction in colour density (in %) of the various dyes when treated with the aftertreatment baths.

To test the effectiveness of the compounds to be used according to the invention, the colour photographic material produced for viewing by reflected light was compared with a material which had the same composition except that it did not contain any of the compounds to be used according to the invention. To carry out the comparison, a point of density 0.7 was found and marked out. The material was then exposed to $7.5\times10^6$ Lux·h of daylight at 60% relative humidity in a South facing exposure station. The lose of colour was then determined by measurement at the same spot. The results are shown in Table 4.

TABLE 4

| Compound No. | Concentration (g/l) | Percentage reduction in colour density | | |
|---|---|---|---|---|
| | | Yellow | Magenta | Cyan |
| None | — | 60 | 72 | 29 |
| 1.18 | 50 | 32 | 40 | 21 |
| 1.24 | 50 | 27 | 35 | 19 |
| 1.26 | 50 | 30 | 38 | 20 |
| 1.27 | 50 | 29 | 33 | 17 |

A marked improvement in stability was achieved when the compounds to be used according to the invention were used in an aftertreatment bath.

EXAMPLE 2

A photographic material was prepared, exposed and processed as described in Example 1. 5% Aqueous solutions of the compounds shown in Table 5 were used as aftertreatment baths.

The stability of the photographic material obtained was determined as described in Example 1 but the material was exposed for $4.8\times10^6$ Lux·h in a xenon test apparatus at 60% relative humidity and 20° C.

TABLE 5

| Compound No. | Concentration (g/l) | Percentage reduction in colour density | | |
|---|---|---|---|---|
| | | Yellow | Magenta | Cyan |
| None | — | 55 | 62 | 34 |
| 1.1 | 50 | 28 | 33 | 22 |
| 1.6 | 50 | 34 | 30 | 19 |

If the aftertreatment bath according to the invention is omitted and instead, the compounds are used at the same concentration in the colour developer, the colour densities are already very low straight after colour development, as shown in Table 6, without any additional exposure of the samples.

TABLE 6

| Addition to colour | Concentration (g/l) | Relative reduction in colour density compared with that of a material developed without additive in the developer (%) | | |
|---|---|---|---|---|
| | | Yellow | Magenta | Cyan |
| none | — | ← Standard → | | |
| 1.1 | 50 | 40 | 61 | 80 |
| 1.6 | 50 | 40 | 57 | 73 |
| 1.18 | 50 | 60 | 73 | 89 |

EXAMPLE 3 (comparison)

When the water-soluble compounds to be used according to the invention are incorporated in the light-sensitive photographic material, they are found to be present only in insufficient quantities, if at all, at the end of processing due to their solubility in the developed material, and therefore cannot develope a sufficient stabilizing action, if any. To demonstrate this, a light-sensitive material was prepared in the same manner as described in Example 1 except that the various emulsions already contained the compounds to be used according to the invention and the quantities of oil formers used were doubled.

1. Magenta emulsion 50 g of each of the compounds to be used according to the invention, dissolved in diethylcarbonate, were added.

2. Yellow emulsion 50 g of one of the compounds to be used according to the invention, dissolved in diethylcarbonate, were added.

3. Cyan emulsion

Addition of 35 g of one of the compounds to be used according to the invention.

The resulting photographic materials were exposed and processed in the same manner as described in Example 2 except that the aftertreatment bath containing one of the compounds to be used according to the invention was omitted. The stability of the photographic material obtained was again determined as described in Example 2. The values obtained are shown in Table 7 below.

TABLE 7

| Addition of Compound No. | Percentage reduction in colour density in the colour separations | | |
|---|---|---|---|
| | Yellow | Magenta | Cyan |
| None | 55 | 62 | 34 |
| 1.1 | 39 | 42 | 31 |
| 1.6 | 45 | 47 | 27 |
| 1.18 | 35 | 39 | 25 |

The stabilization obtained when the compound is added to the photographic material is not satisfactory.

We claim:

1. A process of stabilizing a photographic material containing a support layer, at least one hydrophilic layer of binder and at least one dye image by development of an exposed light-sensitive colour photographic material and treatment in an aftertreatment bath, wherein the aftertreatment bath contains a water-soluble compound corresponding to at least one of the following compounds I, II or III:

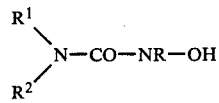

I

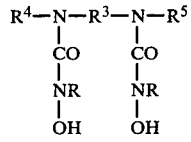

II

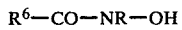

III in which

R represents hydrogen or alkyl $R^1$ represents hydrogen or alkyl $R^2$ represents alkyl, cycloalkyl, aralkyl or aryl;

$R^3$ represents a divalent hydrocarbon group;

$R^4$ and $R^5$, which may be the same or different, represent hydrogen or alkyl $R^6$ represents alkyl, cycloalkyl, aralkyl or aryl and/or $R^1$ and $R^2$ together represent the atoms required to complete a heterocyclic ring and/or $R^3$ together with $R^4$ and optionally also with $R^5$ represent the atoms required to complete a heterocyclic ring.

2. The process according to claim 1 wherein

R represents hydrogen or an alkyl group with not more than 3 carbon atoms;

$R^1$ represents hydrogen or an alkyl group with not more than 5 carbon atoms;

$R^2$ represents an alkyl group with more than 4 carbon atoms;

a cycloalkyl group;

an aralkyl group with not more than 2 carbon atoms in the aliphatic moiety and 6 carbon atoms in the aromatic moiety;

or an aryl group;

$R^3$ represents an alkylene group with not more than 6 carbon atoms;

$R^4$ and $R^5$ which may be the same or different represent hydrogen or an alkyl group with not more than 3 carbon atoms;

$R^6$ represents an alkyl group with not more than 6 carbon atoms;

cyclopentyl or cyclohexyl with 5 or 6 carbon atoms;

an aralkyl group with not more than 2 carbon atoms in the aliphatic moiety and 6 carbon atoms in the aromatic moiety;

or phenyl;

and/or $R^1$ and $R^2$ may together represent the atoms required to complete a heterocyclic ring and/or $R^3$ together with $R^4$ and optionally also $R^5$ represent the atoms required to complete a heterocyclic ring.

3. A color photographic material consisting of (a) a support layer and (b) at least one hydrophilic layer of binder containing a dye image, said material containing at least one compound corresponding to one of the following compounds I–III:

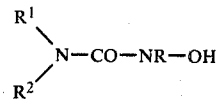

I

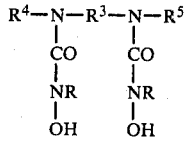

II

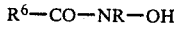

III in which

R represents hydrogen or an alkyl group with not more than 3 carbon atoms;

$R^1$ represents hydrogen or an alkyl group with not more than 5 carbon atoms;

$R^2$ represents an alkyl group with not more than 4 carbon atoms;

a cycloalkyl group with 5 or 6 carbon atoms;

an aralkyl group with not more than 2 carbon atoms in the aliphatic moiety and 6 carbon atoms in the aromatic moiety or a phenyl group;

$R^3$ represents an alkylene group with not more than 6 carbon atoms, or a phenyl group;

$R^4$ and $R^5$ which may be the same or different represent hydrogen or an alkyl group, in particular with not more than 3 carbon atoms, specifically methyl, ethyl or propyl;

$R^6$ represents an alkyl group with not more than 6 carbon atoms;

a cycloalkyl group with 5 or 6 atoms;

an aralkyl group with not more than 2 carbon atoms in the aliphatic moiety and 6 carbon atoms in the aromatic moiety;

or a phenyl group, and/or $R^1$ and $R^2$ may together represent the atoms required to complete a heterocyclic ring and/or $R^3$ together with $R^4$ and optionally also $R^5$ represent the atoms required to complete a heterocyclic ring.

* * * * *